US008796574B2

(12) United States Patent
Kishi et al.

(10) Patent No.: US 8,796,574 B2
(45) Date of Patent: Aug. 5, 2014

(54) SWITCH

(75) Inventors: Shigenobu Kishi, Ritto (JP); Yuya Kudo, Kurayoshi (JP); Takayuki Abe, Kurayoshi (JP); Kenichi Ando, Okayama (JP); Hidemi Nakamura, Tottori (JP)

(73) Assignee: Omron Corporation, Kyoto (JP)

( * ) Notice: Subject to any disclaimer, the term of this patent is extended or adjusted under 35 U.S.C. 154(b) by 253 days.

(21) Appl. No.: 13/256,948

(22) PCT Filed: Mar. 23, 2011

(86) PCT No.: PCT/JP2011/057000

§ 371 (c)(1),
(2), (4) Date: Mar. 6, 2012

(87) PCT Pub. No.: WO2010/125949

PCT Pub. Date: Nov. 4, 2010

(65) Prior Publication Data

US 2012/0152714 A1 Jun. 21, 2012

(30) Foreign Application Priority Data

Oct. 12, 2010 (JP) ..... 2010-229648

(51) Int. Cl.
*H01H 5/08* (2006.01)

(52) U.S. Cl.
USPC ..... 200/467

(58) Field of Classification Search
USPC ..... 200/408, 409, 412, 441, 443, 451, 467, 200/510, 540, 573, 254, 337, 341, 345
See application file for complete search history.

(56) References Cited

U.S. PATENT DOCUMENTS

| | | | | |
|---|---|---|---|---|
| 2,800,546 | A * | 7/1957 | Reitler | 200/463 |
| 4,673,778 | A * | 6/1987 | Lewandowski et al. | 200/467 |
| 5,171,945 | A * | 12/1992 | Su | 200/6 R |
| 6,399,908 | B1 * | 6/2002 | Mueller et al. | 200/249 |

FOREIGN PATENT DOCUMENTS

JP 9-120731 A 5/1997

* cited by examiner

*Primary Examiner* — Edwin A. Leon
*Assistant Examiner* — Anthony R. Jimenez
(74) *Attorney, Agent, or Firm* — Osha Liang LLP

(57) ABSTRACT

A switch includes a movable contact piece having one end as a supporting point of turn and the other end arranged with a movable contact, a turning member having the other end as a supporting point of turn, a coil spring having one end locked to one end of the turning member and the other end locked to an intermediate portion of the movable contact piece, and a push button supported and slidable in an up and down direction. The movable contact piece is inverted by pushing down the one end of the turning member with the push button so as to make the movable contact approach and separate from a fixed contact. The turning member includes a position regulating portion that is brought into contact with the coil spring and brings the movable contact into contact with the fixed contact while maintaining a contact state with the coil spring.

6 Claims, 13 Drawing Sheets

SWITCH

CROSS-REFERENCE TO RELATED APPLICATIONS

The present application claims priority from Japanese Patent Application No. 2010-229648, filed Oct. 12, 2010. The content of the priority application is hereby incorporated by reference in its entirety.

BACKGROUND OF INVENTION

1. Technical Field

One or more embodiments of the present invention relate to switches, and in particular, to a push switch with a small operating sound.

2. Background Art

Conventionally, there is known a push switch in which a turning member is pushed down with a push button and a movable contact piece is inverted with a spring force of a coil spring coupled to the turning member so as to make a movable contact arranged on the movable contact piece approach and separate to and from a fixed contact (see Patent Document 1).

Patent Document 1: Japanese Unexamined Patent Publication No. 9-120731

SUMMARY OF THE INVENTION

The above-described push switch has a large operating sound generated when the movable contact arranged on the movable contact piece comes into contact with the fixed contact.

A switch according to one or more embodiments of the present invention includes a movable contact piece having one end as a supporting point of turn and the other end arranged with a movable contact; a turning member having the other end as a supporting point of turn; a coil spring having one end locked to one end of the turning member and the other end locked to an intermediate portion of the movable contact piece; and a push button being supported to be slidable in an up and down direction and for pushing down the one end of the turning member with a lower end face; the movable contact piece being inverted by pushing down the one end of the turning member with the push button so as to make the movable contact approach and separate to and from a fixed contact; wherein the turning member includes a position regulating portion that is brought into contact with the coil spring when the movable contact piece is inverted and that brings the movable contact into contact with the fixed contact while maintaining a contact state with the coil spring.

According to one or more embodiments of the present invention, the coil spring is brought into contact with the turning member when the movable contact piece is inverted, so that the sudden inversion operation of the movable contact piece can be suppressed, and the movable contact can be brought into contact with the fixed contact while maintaining the contact state of the turning member and the coil spring. The operating sound that is generated when the movable contact collides with the fixed contact thus can be reduced.

As the contact can be opened and closed with a snap action, application can be made even to a switch of medium load from about a few hundred mA to a few A.

In another aspect of one or more embodiments of the invention, a switch includes a movable contact piece having one end as a supporting point of turn and the other end arranged with a movable contact; a turning member having the other end as a supporting point of turn; a coil spring having one end locked to one end of the turning member and the other end locked to an intermediate portion of the movable contact piece; and a push button being supported to be slidable in an up and down direction and for pushing down the one end of the turning member with a lower end face; the movable contact piece being inverted by pushing down the one end of the turning member with the push button so as to make the movable contact approach and separate to and from a fixed contact; wherein the turning member includes a position regulating projecting portion that is brought into contact with the inverted movable contact piece and that brings the movable contact into contact with the fixed contact while maintaining a contact state with the movable contact piece.

According to one or more embodiments of the present invention, the position regulating projecting portion arranged on the turning member is brought into contact with the movable contact piece when the movable contact piece is inverted, so that the sudden inversion operation of the movable contact piece can be suppressed, and the movable contact is brought into contact with the fixed contact with the movable contact piece and the position regulating projecting portion in the contact state. Thus, the operating sound that is generated when the movable contact collides with the fixed contact can be reduced.

As the contact can be opened and closed with a snap action, application can be made even to a switch of medium load from about a few hundred mA to a few A.

In accordance with another aspect of one or more embodiments of the invention, a switch includes a movable contact piece having one end as a supporting point of turn and the other end arranged with a movable contact; a turning member having the other end as a supporting point of turn; a coil spring having one end locked to one end of the turning member and the other end locked to an intermediate portion of the movable contact piece; and a push button being supported to be slidable in an up and down direction and for pushing down the one end of the turning member with a lower end face; the movable contact piece being inverted by pushing down the one end of the turning member with the push button so as to make the movable contact approach and separate to and from a fixed contact; wherein the movable contact piece includes a position regulating projecting portion that is brought into contact with the turning member when inverted and that brings the movable contact into contact with the fixed contact while maintaining a contact state with the turning member.

According to one or more embodiments of the present invention, the position regulating projecting portion arranged on the movable contact piece is brought into contact with the turning member when the movable contact piece is inverted, so that the sudden inversion operation of the movable contact piece can be suppressed, and the movable contact is brought into contact with the fixed contact with the turning member and the position regulating projecting portion in the contact state. Thus, the operating sound that is generated when the movable contact collides with the fixed contact can be reduced.

As the contact can be opened and closed with a snap action, application can be made even to a switch of medium load from about a few hundred mA to a few A.

In one or more embodiments of the present invention, the position regulating projecting portion may be formed through projection work.

According to the present embodiment, a switch in which the number of components and the number of assembly steps is few and in which productivity is high is obtained.

DETAILED DESCRIPTION

Figure 1A:
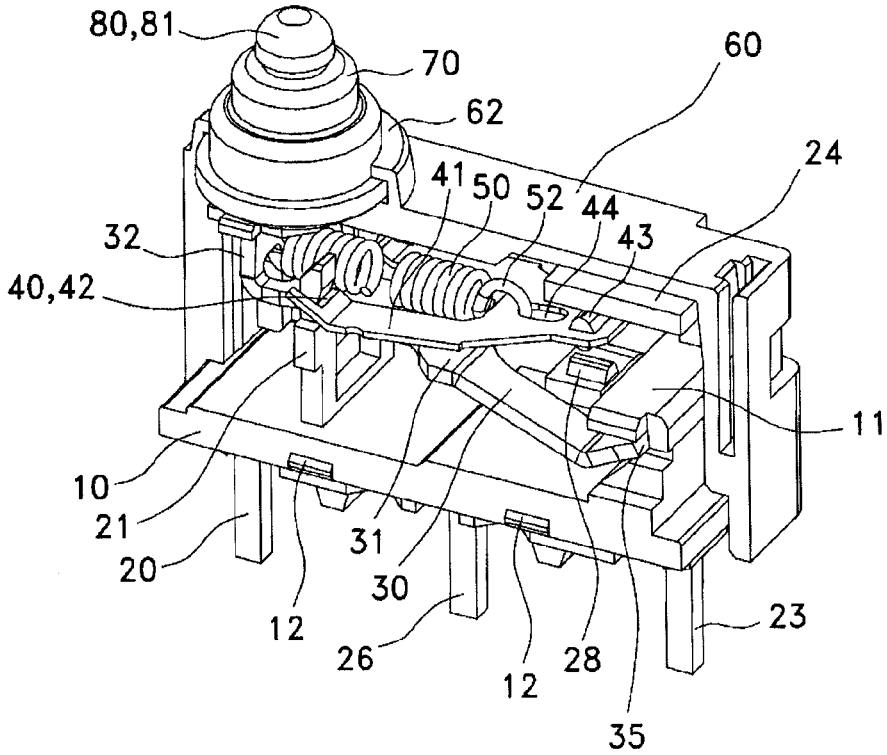
FIGS. 1A and 1B are perspective views showing a first embodiment of a switch according to the present invention.
Figure 1B:
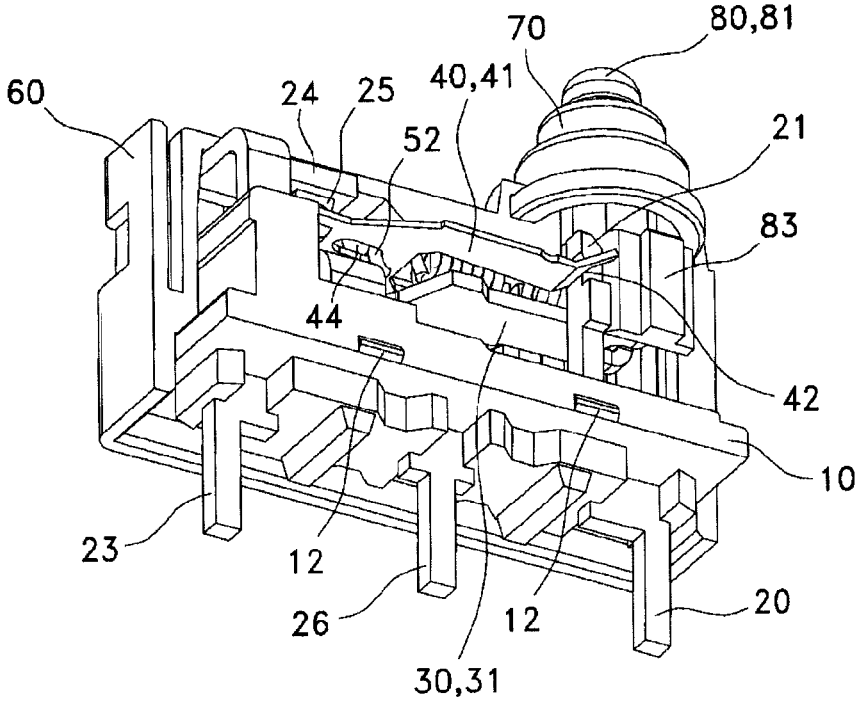

Embodiments of a switch according to the present invention will be described with reference to FIGS. 1A to 12 of the accompanied drawings. In embodiments of the invention, numerous specific details are set forth in order to provide a more thorough understanding of the invention. However, it will be apparent to one with ordinary skill in the art that the invention may be practiced without these specific details. In other instances, well-known features have not been described in detail to avoid obscuring the invention.

As shown in FIGS. 1A to 8, a switch according to a first embodiment is configured by assembling a turning member 30, a movable contact piece 40, and a coil spring 50 in a sealed space formed by a base 10 and a case 60, and assembling a push button 80, which is an operation member, to the case 60 by way of a dustproof cover 70.

Figure 2:
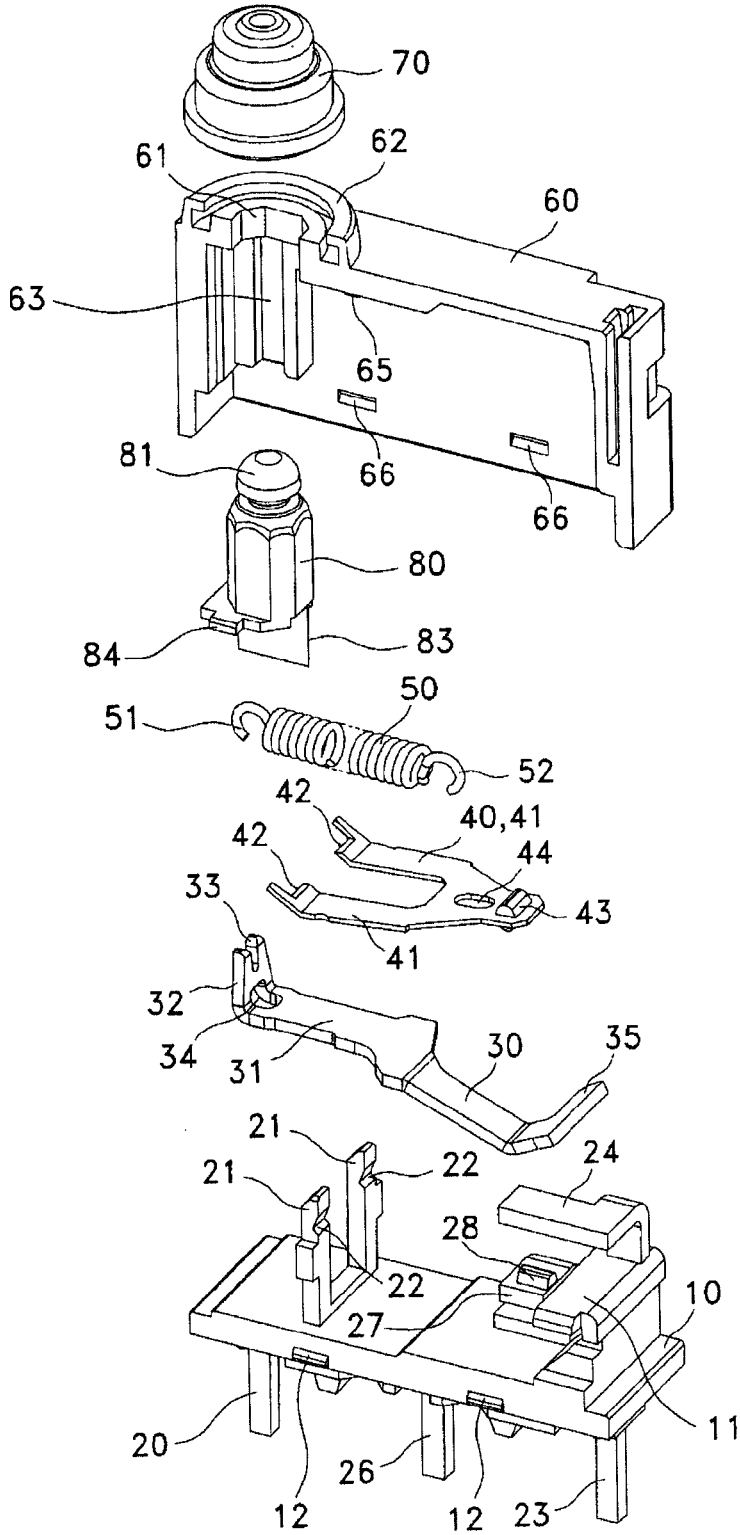
FIG. 2 is an exploded perspective view of the switch shown in FIG. 1A.
Figure 3:
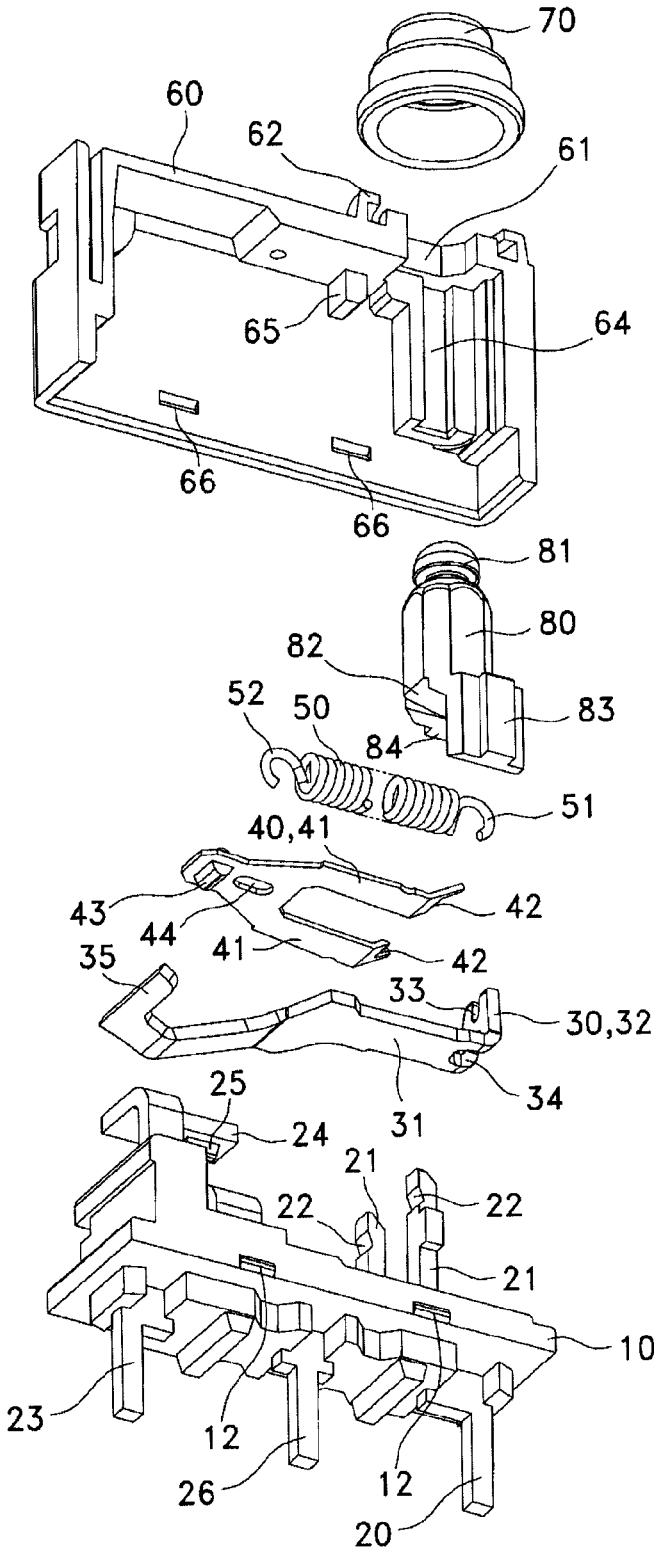
FIG. 3 is an exploded perspective view of the switch shown in FIG. 1B.
Figure 4A:
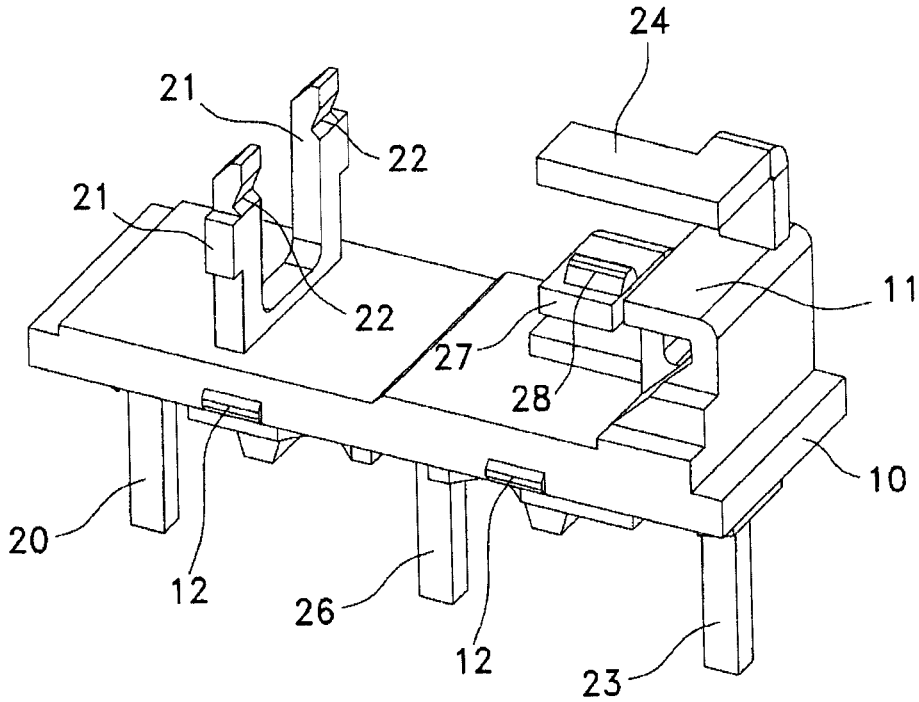
FIGS. 4A and 4B are perspective views of a base including a terminal of the switch shown in FIG. 1A and of only the terminal.
Figure 4B:
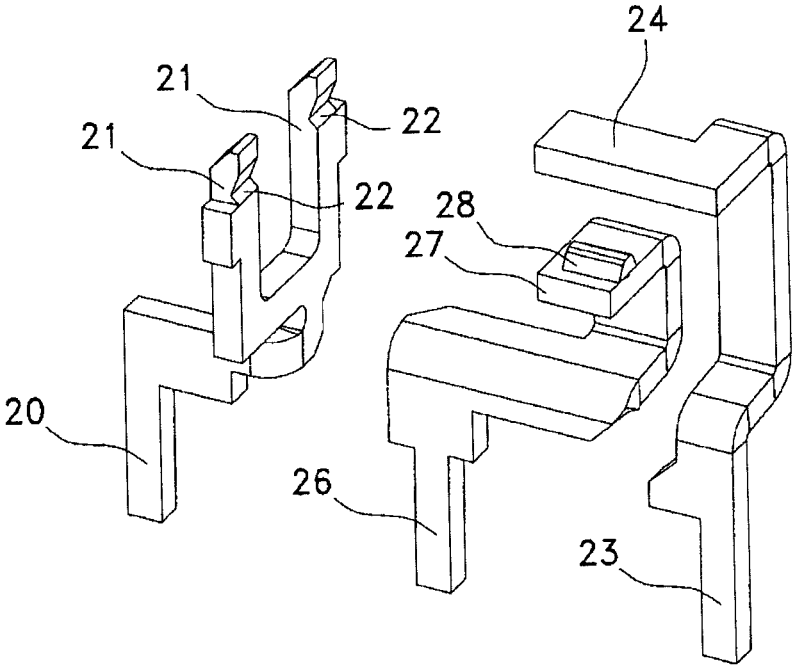
Figure 5A:
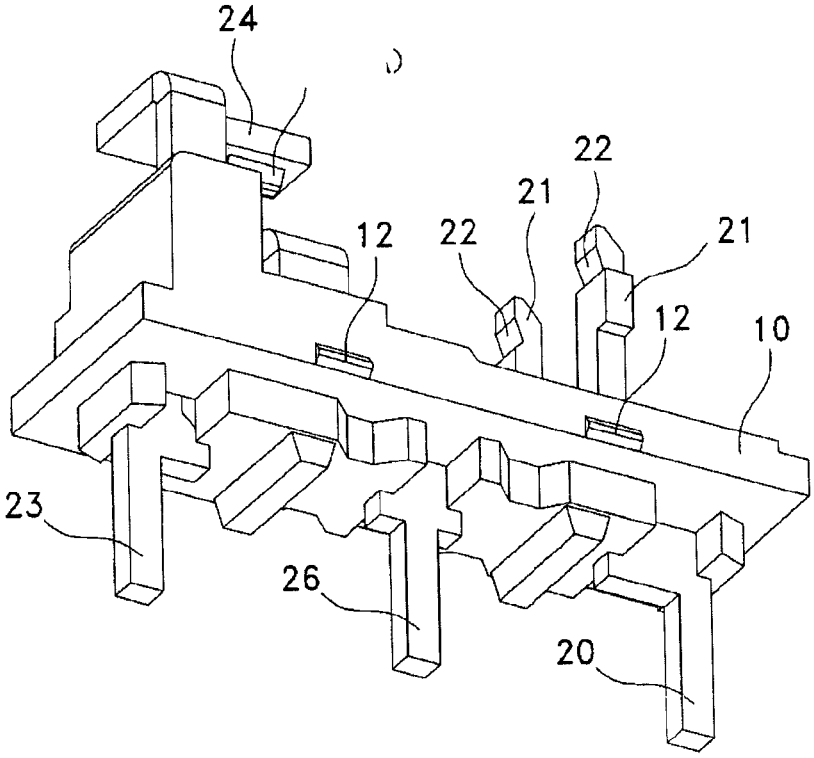
FIGS. 5A and 5B are perspective views of a base including a terminal of the switch shown in FIG. 1B and of only the terminal.
Figure 5B:
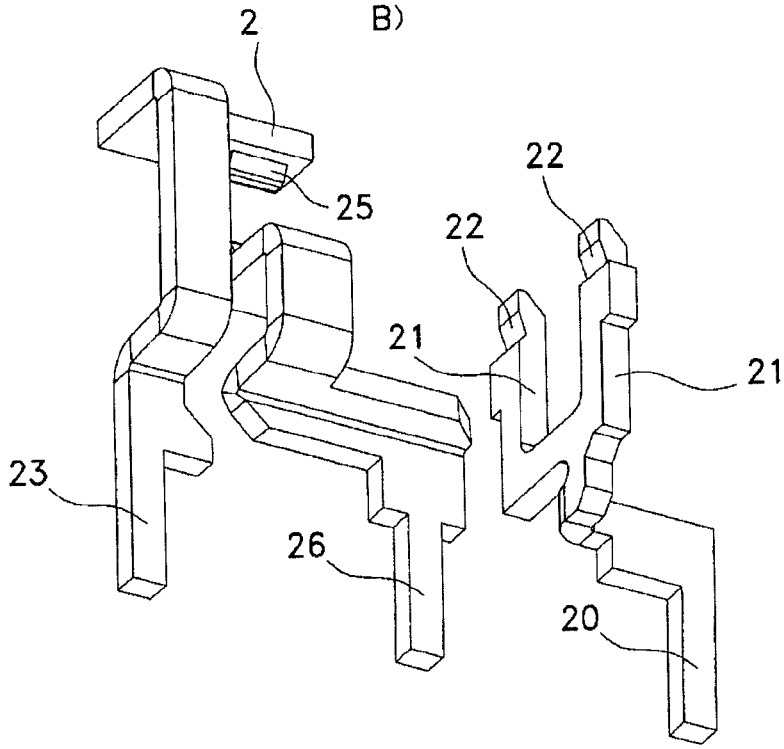

As shown in FIGS. 2 and 3, the base 10 is insert molded with a common terminal 20, a constantly-closed fixed contact terminal 23, and a constantly-opened fixed contact terminal 26. A turn receiving portion 11 for turnably supporting the turning member 30, to be described later, is formed at the base of the constantly-closed fixed contact terminal 23 of the upper surface of the base 10. An engagement nail portion 12 is arranged in a projecting manner on both opposing side surfaces of the base 10.

As shown in FIGS. 4A and 4B, and FIGS. 5A and 5B, the common terminal 20 includes a pair of arms 21, 21 projecting out from the upper surface of the base 10 and being divided into two, where an engagement receiving portion 22 that acts as a supporting point of turn is arranged on the inward surface side of the respective arm 21. The constantly-closed fixed contact terminal 23 includes a constantly-closed fixed contact 25 at the lower surface of a distal end 24 projected out from the upper surface of the base 10 and bent. Furthermore, the constantly-opened fixed contact terminal 26 includes a constantly-opened fixed contact 28 at the upper surface of a distal end 27 projected out from the upper surface of the base 10 and bent. The constantly-closed fixed contact 25 and the constantly-opened fixed contact 28 are arranged to face each other with a movable contact 43, to be described later, therebetween.

The turning member 30 has substantially the central part bent to form a position regulating portion 31, where a distal end on one end side thereof is raised up at a substantially right angle to form a raised piece 32 and a distal end on the other end side is extended to the side to include a turning hinge portion 35. The raised piece 32 includes a cutout groove 33 at the distal end and includes a lock hole 34 at the base.

The movable contact piece 40 has a substantially V-shape with a pair of legs 41, 41, where engagement cutout portions 42, 42 that lock to the engagement receiving portions 22, 22 of the arms 21, 21 are each arranged at the distal end of the leg 41, and the movable contact 43 is arranged at the other end on the opposite side. A lock hole 44 is formed near the inner side of the movable contact 43.

The coil spring 50 ensures the contact pressure and provides an inversion force on the movable contact piece 40, where one end thereof is locked to the lock hole 34 through the cutout groove 33 of the turning member 30 and the other end is locked to the lock hole 44 of the movable contact piece 40.

As shown in FIGS. 2 and 3, the case 60 has a box shape that can be fitted to the base 10, and includes an operation hole 61, through which an operation member 80 to be described later can be inserted, on one side of the upper surface, and also includes an annular rib 62, to which the dustproof cover 70 can be attached, at an edge on the upper side of the opening of the operation hole 61. The case 60 also includes guide grooves 63, 64 on the inner side surfaces being positioned on the lower side of the operation hole 61 and facing each other. As shown in FIG. 3, the case 60 has a position regulating tongue piece 65 for regulating the position of the arm 21 of the common terminal 20 arranged in a projecting manner on a roof surface. The case 60 includes an engagement hole 66 in the vicinity of an opening edge of the opposing side surfaces.

The dustproof cover 70 is made from an elastic material such as rubber, and the opening on the lower side thereof is attached to the annular rib 62 of the case 60.

The push button 80 has a cross-sectional shape that can be inserted to the operation hole 61 of the case 60, and includes an operation head 81 at the upper end as well as a guide protrusion 83 and a guide projection 84 at opposing positions of the outer peripheral edge of a lower end face 82.

A method of assembling the switch according to the present embodiment will now be described.

The position regulating portion 31 of the turning member 30 is arranged between the arms 21 of the common terminal 20 of the three terminals 20, 23, 26 insert molded to the base 10, and the turning hinge portion 35 is positioned in the turn receiving portion 11 of the base 10. The engagement cutout portion 42 of the movable contact piece 40 in which the other end 52 of the coil spring 50 is locked to the lock hole 44 is locked to the engagement receiving portion 22 of the common terminal 20, and the one end 51 of the coil spring 50 is locked to the lock hole 34 through the cutout groove 33 of the turning member 30. The movable contact 43 is thereby arranged between the constantly-closed fixed contact 25 and the constantly-opened fixed contact 28 so as to alternately approach and separate thereto, and is biased to the upper side. The movable contact 43 before the operation is thus comes into pressure contact with the constantly-closed fixed contact 25.

The dustproof cover 70 is attached to the annular rib 62 of the case 60. The push button 80 is inserted to the operation hole 61 of the case 60, and the guide protrusion 83 and the guide projection 84 of the push button 80 are respectively slidably fitted to the guide grooves 63, 64 of the case 60. The operation head 81 of the push button 80 is projected out from the dustproof cover 70 so that the push button 80 is slidably supported. Lastly, an engagement hole 66 of the case 60 is engaged to the engagement nail portion 12 of the base 10 so that the position regulating tongue piece 65 of the case 60 is brought into contact with the arm 21 of the common terminal 20 to regulate its position, and the lower end face 82 of the push button 80 is brought into contact with the upper end of the raised piece 32 of the turning member 30 so as to be able to push down the same.

The operation of the switch will now be described according to FIGS. 6A to 8 of the accompanied drawings.

Figure 6A:
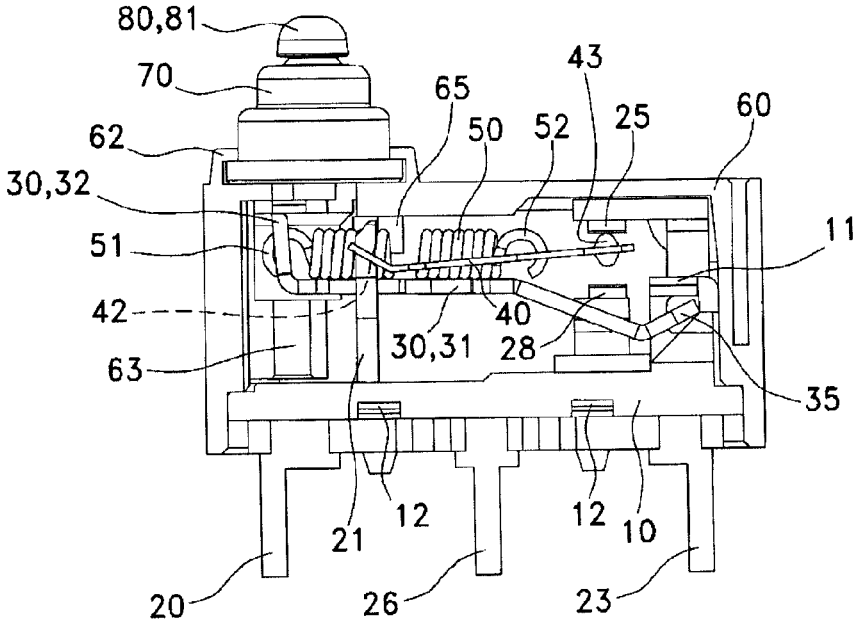
FIGS. 6A and 6B are cross-sectional views describing the operation of the switch according to the first embodiment.

First, as shown in FIG. 6A, with the spring force of the coil spring 50 before the operation, the movable contact 43 of the movable contact piece 40 is brought into contact with the constantly-closed fixed contact 25 and the coil spring 50 is brought into contact with the position regulating portion 31 of the turning member 30.

Figure 6B:
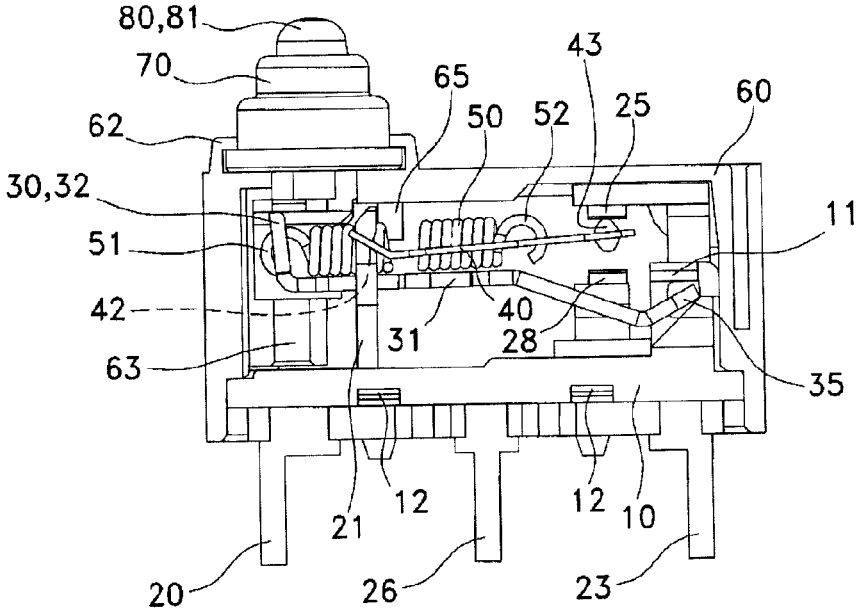

When the push button 80 is pushed down, the lower end face 82 thereof pushes down the upper end of the raised piece 32 of the turning member 30 so that the turning member 30 turns with the turning hinge portion 35 as the supporting point. The coil spring 50 is thereby extended, and the coil spring 50 is separated from the position regulating portion 31 of the turning member 30 (FIG. 6B).

The movable contact piece 40 starts to invert when a lock point of the one end 51 of the coil spring 50 and the turning member 30 reaches a line connecting a lock point of the movable contact piece 40 and the other end 52 of the coil spring 50 and a lock point of the engagement cutout portion 42 of the movable contact piece 40 and the engagement receiving portion 22 of the common terminal 20. However, the coil spring 50 is brought into contact with the position regulating portion 31 of the turning member 30 (FIG. 7A) to regulate the sudden inversion operation of the movable contact piece 40.

Figure 7A:
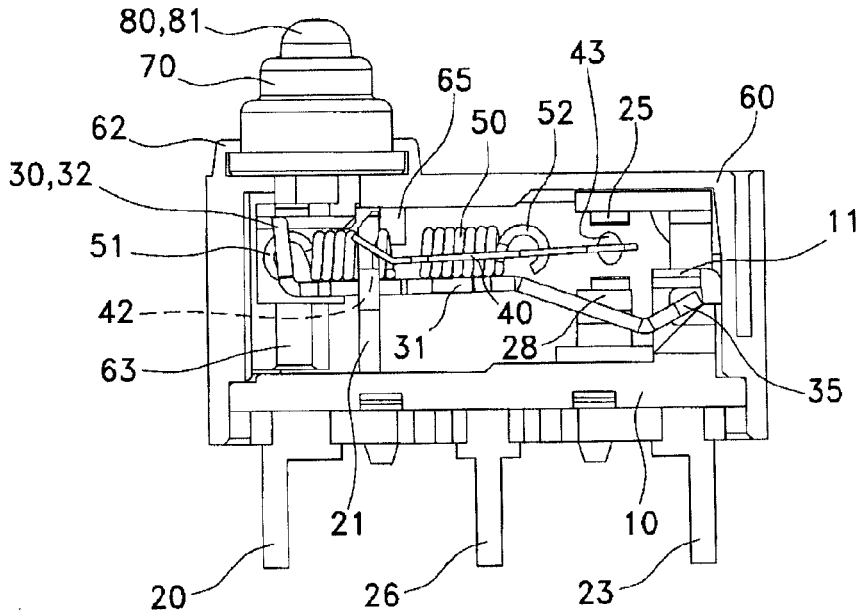
FIGS. 7A and 7B are cross-sectional views describing the operation following FIG. 6B.
Figure 7B:
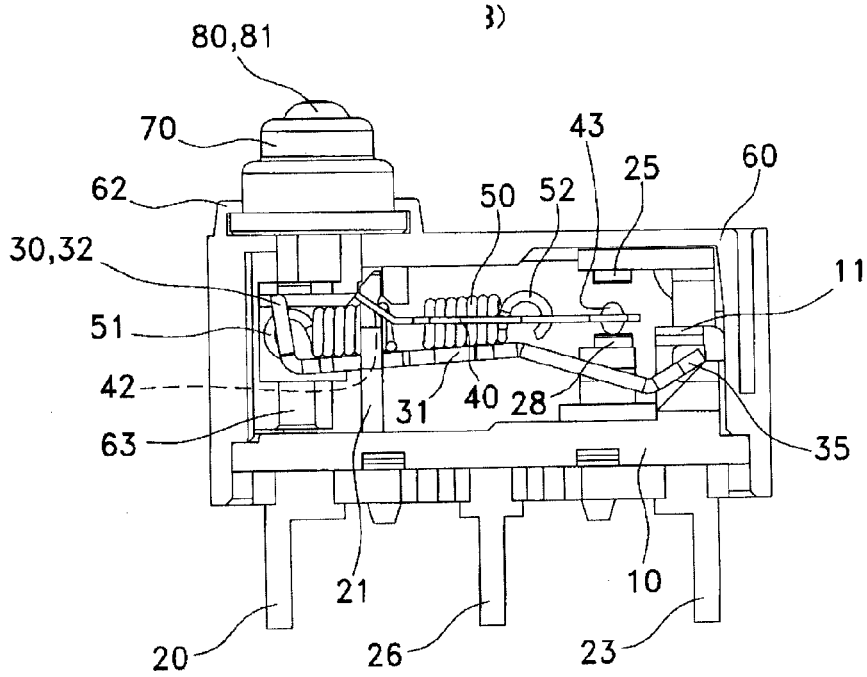
Figure 8:
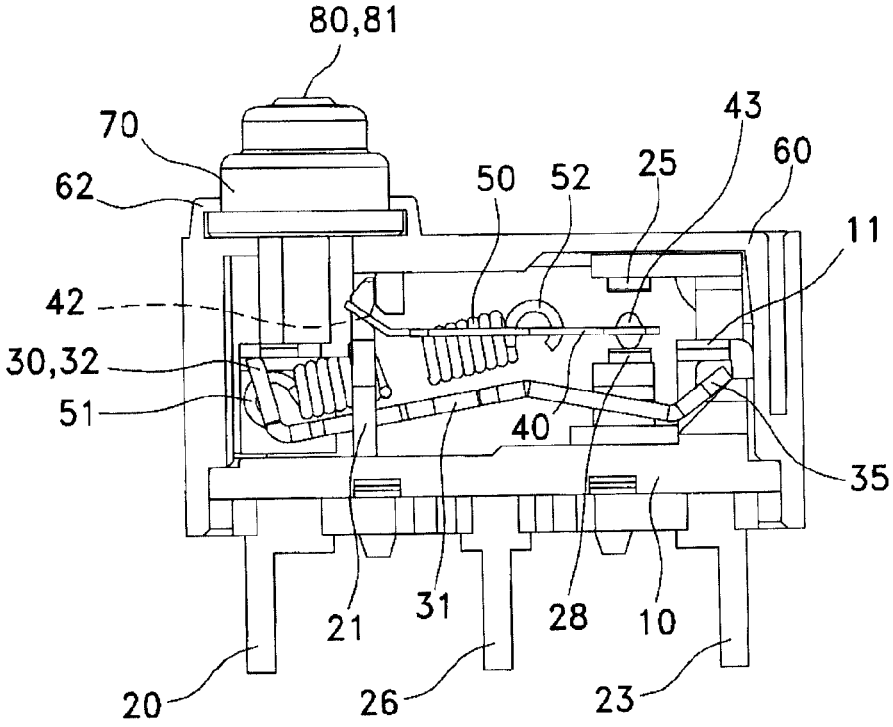
FIG. 8 is a cross-sectional view describing the operation following FIG. 7B.
Figure 9A:
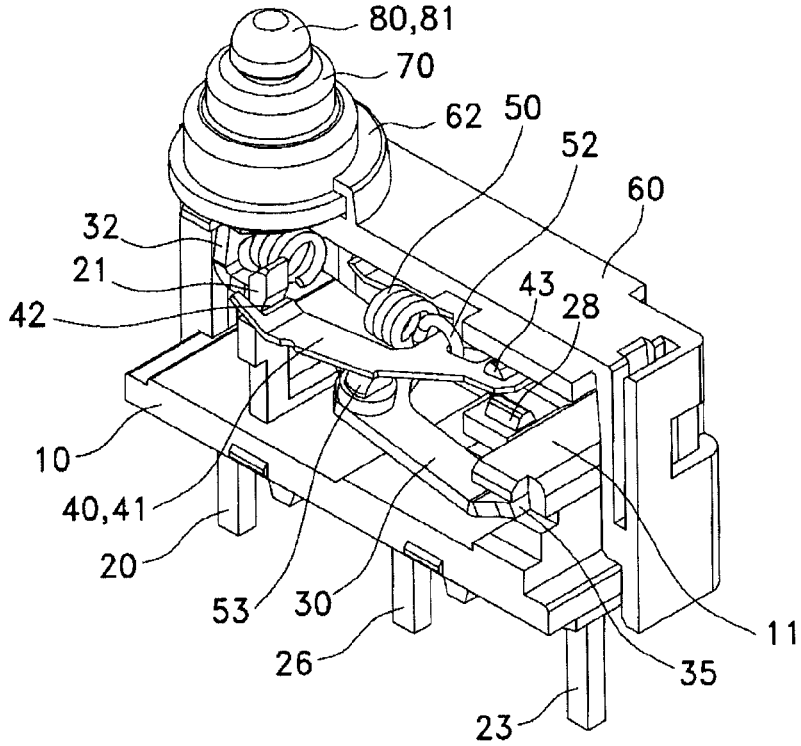
FIGS. 9A and 9B are perspective views showing a second embodiment of a switch according to the present invention.
Figure 9B:
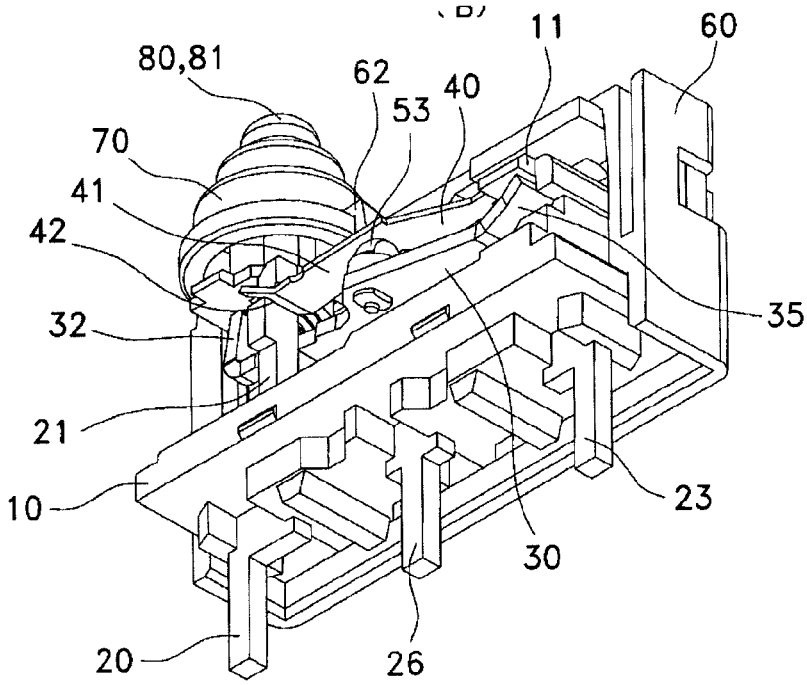
Figure 10A:
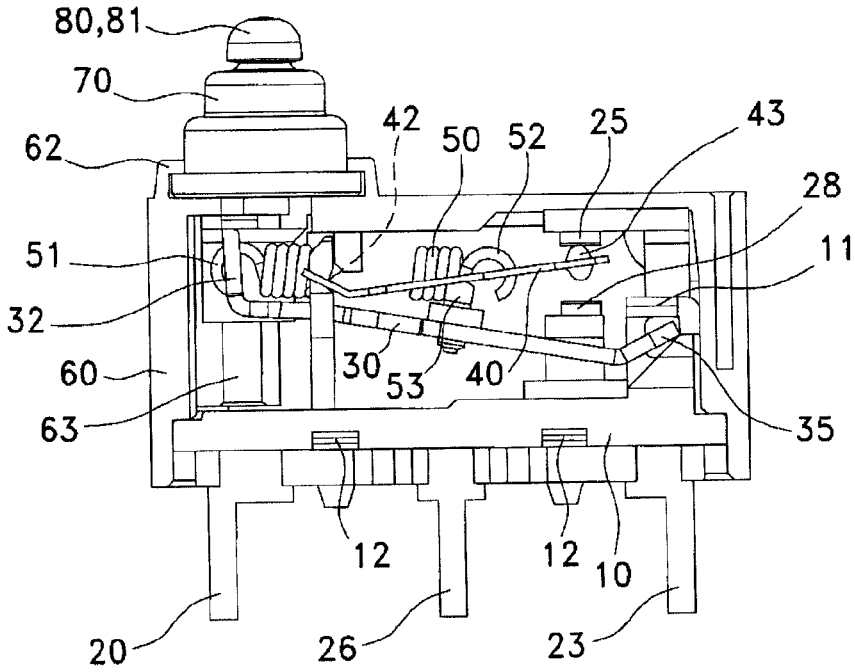
FIGS. 10A and 10B are a front cross-sectional view and a rear cross-sectional view of the switch shown in FIG. 9.
Figure 10B:
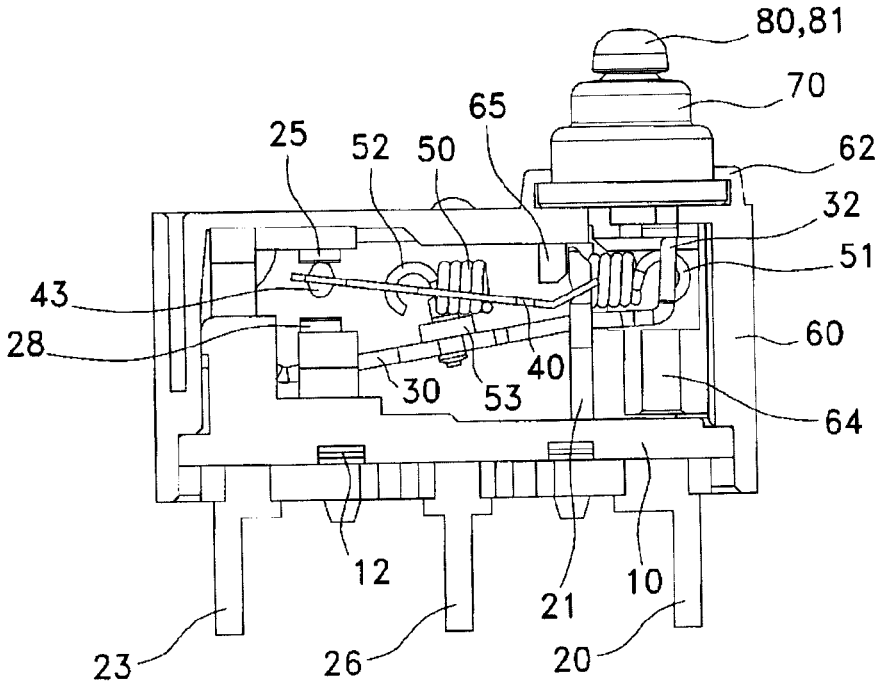
Figure 11:
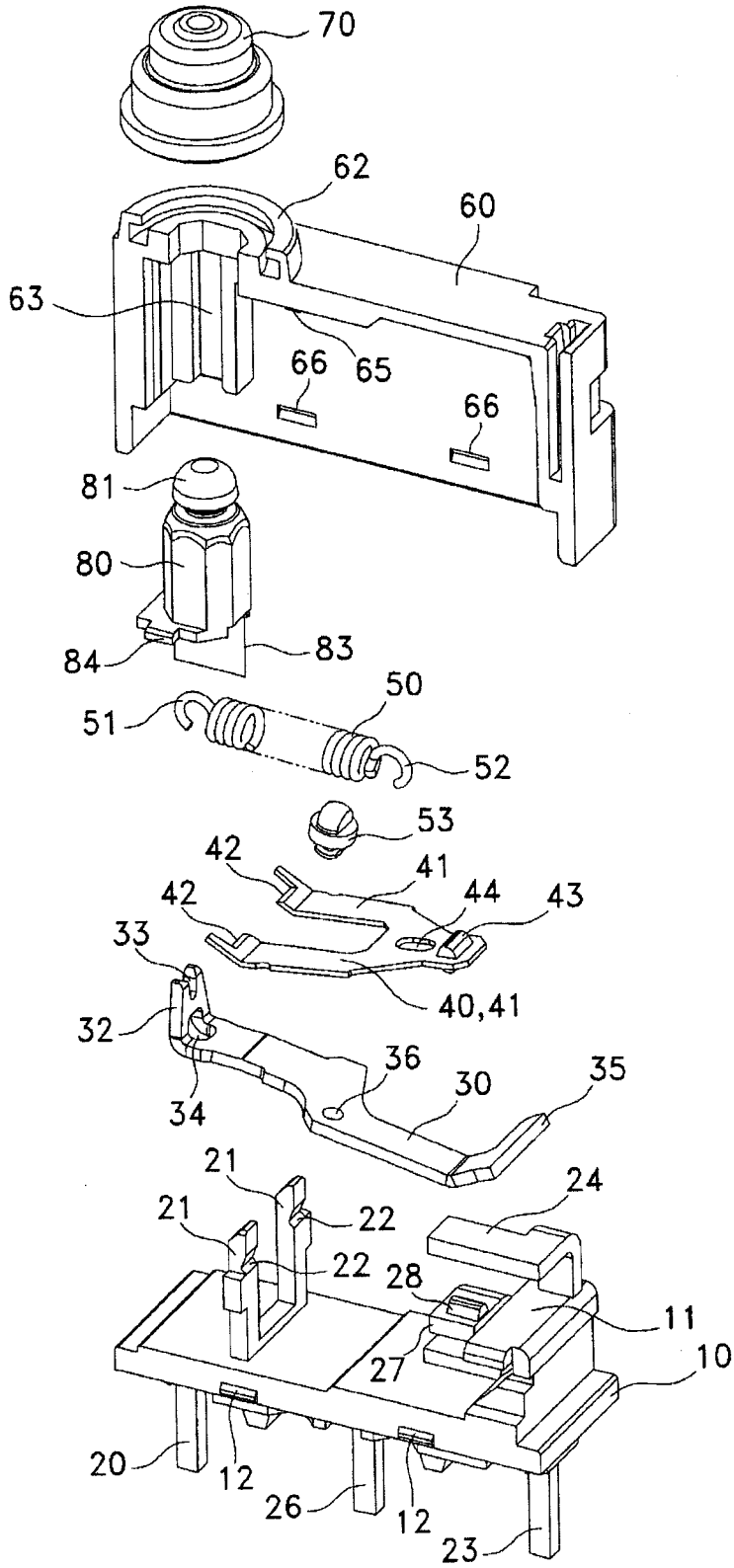
FIG. 11 is an exploded perspective view of the switch shown in FIG. 9A.
Figure 12:
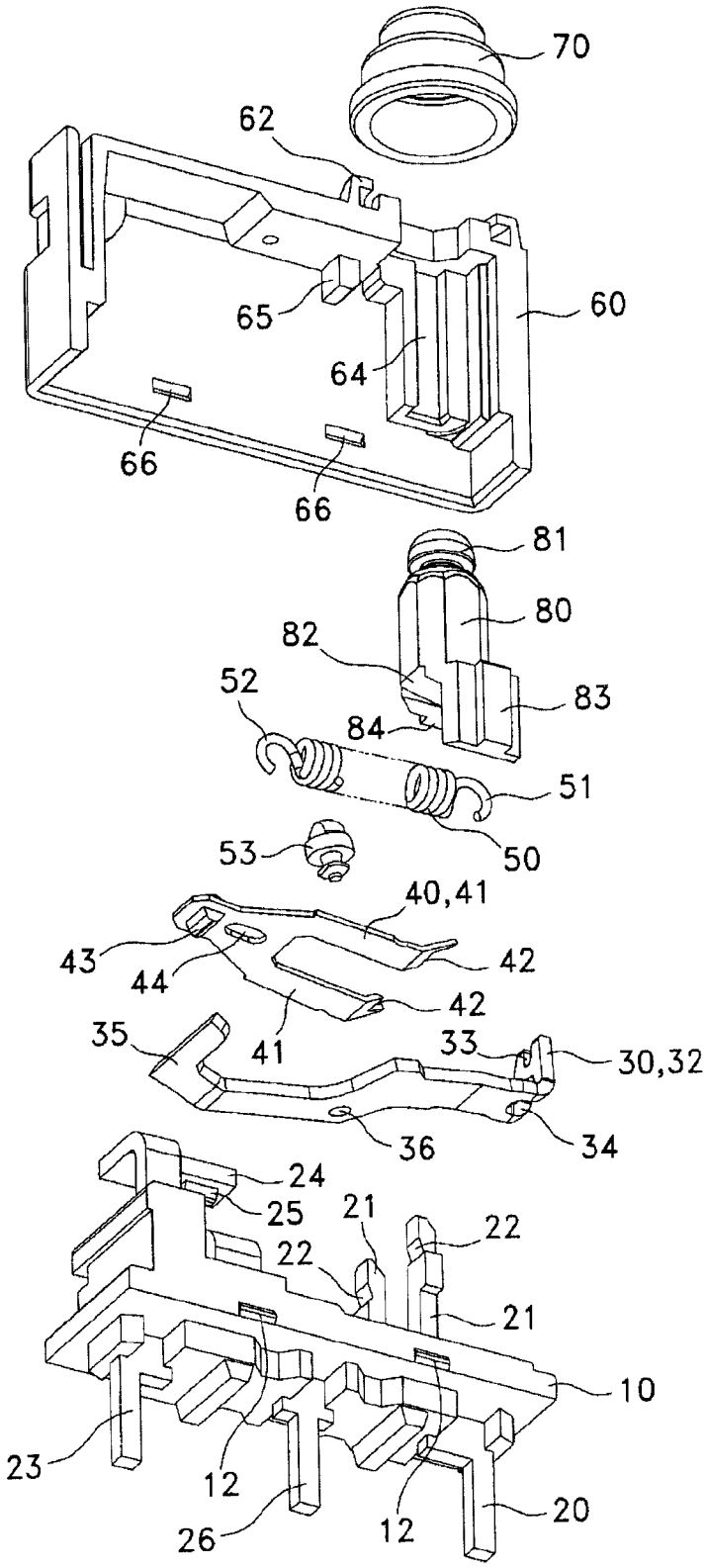
FIG. 12 is an exploded perspective view of the switch shown in FIG. 9B seen from a different angle.

Then, by the further push-down operation of the push button 80, the turning member 30 and the coil spring 50 are turned in the contact state and the movable contact 43 is brought into contact with the constantly-opened fixed contact 28 (FIG. 7B). Furthermore, the turning member 30 is turned and the coil spring 50 is extended by pushing down the push button 80, so that the movable contact 43 comes into pressure contact with the constantly-opened fixed contact 28 at a predetermined contact pressure (FIG. 8). Thus, the movable contact 43 does not collide with the constantly-opened fixed contact 28 with the sudden inversion operation of the movable contact piece 40, and the collision sound as in the conventional art does not occur.

When the pushing force on the push button 80 is released, the movable contact 43 is separated from the constantly-opened fixed contact 28 through steps opposite to the above, and is brought into contact with the constantly-closed fixed contact 25, and thereafter, the turning member 30 and the coil spring 50 are returned to the original position.

As shown in FIGS. 9A to 12, a second embodiment is substantially similar to the first embodiment described above in the basic configuration, and differs in that bending work is not performed on the central part of the turning member 30 to form the position regulating portion and a position regulating projecting portion 53 of a separate body is arranged on the turning member 30.

In other words, in the present embodiment, the position regulating projecting portion 53 is fixed to an attachment hole 36 (FIG. 11) formed in the turning member 30. Others are substantially similar to the first embodiment described above, and hence the same numbers are denoted on the same portions and the description thereof will be omitted.

In the present embodiment, the movable contact piece 40 is brought into contact with the position regulating projecting portion 53 arranged on the turning member 30 to regulate the sudden inversion operation of the movable contact piece 40 at the time of inversion of the movable contact piece 40 in the middle of the operation. The collision of the movable contact 43 on the constantly-opened fixed contact 28 is thereby suppressed, and the operating sound is reduced.

According to the present embodiment, the bending work does not need to be performed on the turning member because the position regulating projecting portion 53 of a separate body is arranged on the turning member 30, whereby high component accuracy and assembly accuracy are obtained. Furthermore, the design is facilitated because the inversion operation of the movable contact piece 40 can be adjusted by simply adjusting the height dimension of the position regulating projecting portion 53.

The operating sound at the time of opening/closing the contact was measured with respect to five samples of the example having a structure of the first embodiment and five samples of the comparative example in which bending work is not performed on the turning member and the position regulating portion is not formed. In the comparative example, the coil spring is not brought into contact with the turning member in the no-load state.

As a measurement method, the sample was mounted on a sound absorbing material having a thickness of 6.35 mm placed on the floor surface of an anechoic sound chamber. The microphone was arranged at a position 300 mm immediately above the sample, and the operating sound at the time of opening and closing was measured.

As a result of the measurement, the operating sound of the example was on an average 21.0 db whereas the operating sound of the comparative example was on an average 34.4 db, and hence the operating sound was found to be reduced by 40%.

Figure 13A:
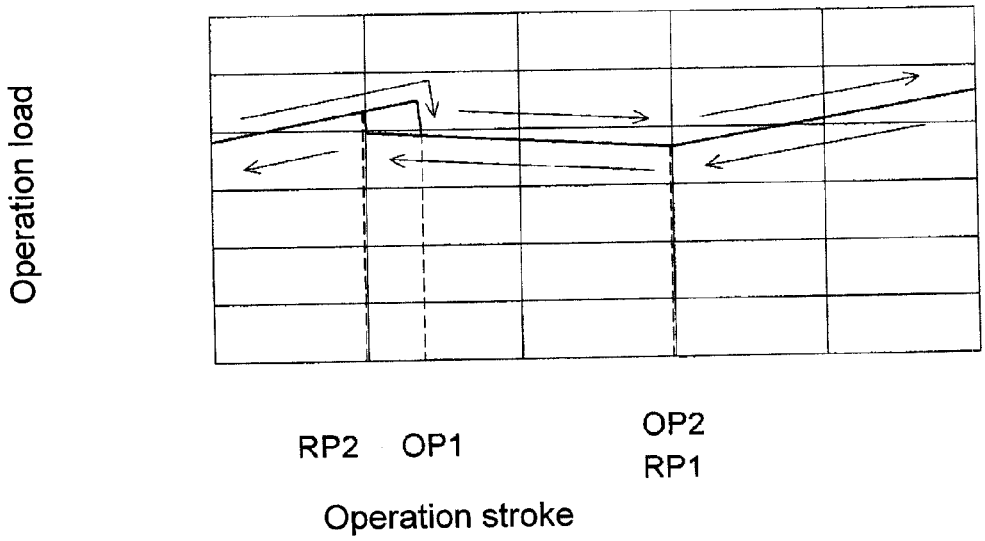
FIGS. 13A and 13B are graphs showing a correlation between an operation stroke and an operation load according to an example of one or more embodiment of the present invention and a comparative example.
Figure 13B:
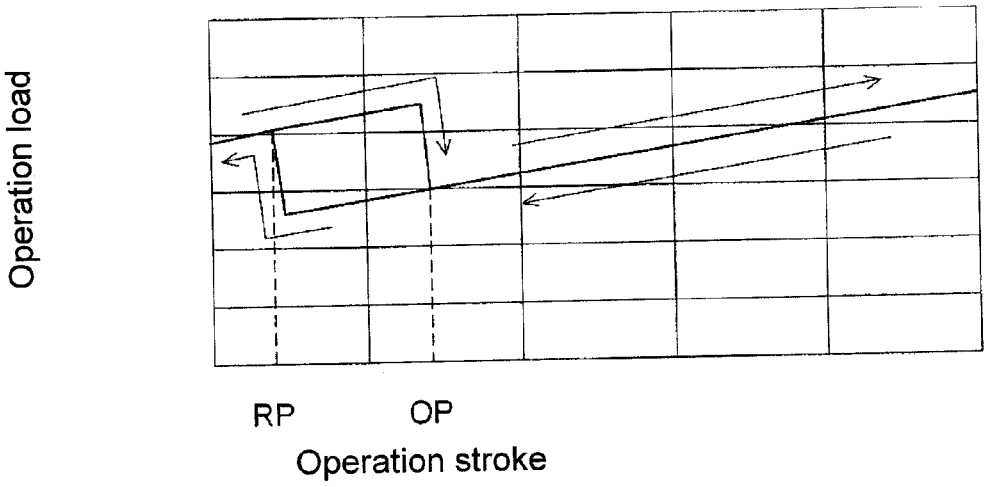

The reduction in the operating sound is also apparent from FIG. 13A (example) and FIG. 13B (comparative example) showing a correlation between the operation stroke and the operation load. The arrows in the figures show the operation order.

In other words, an operating point 1 (OP1) in FIG. 13A shows the position where the coil spring 50 and the position regulating portion 31 of the turning member 30 are brought into contact (FIG. 7A), and an operating point 2 (0P2) shows the position where the movable contact 43 is brought into contact with the constantly-opened fixed contact 28 (FIG. 7B). Furthermore, a release point (RP1) shows the position where the movable contact 43 is separated from the constantly-opened fixed contact 28, and a release point 2 (RP2) shows the position where the coil spring 50 is separated from the position regulating portion 31 of the turning member 30 and where the movable contact 43 is brought into contact with the constantly-closed fixed contact 25.

Meanwhile, an operating point (OP) in FIG. 13B shows the position where the movable contact is brought into contact with the constantly-opened fixed contact and a release point RP (RP) shows the position where the movable contact is brought into contact with the constantly-closed fixed contact.

Therefore, in the case of the example shown in FIG. 13A, the amount of change in the operation load between the release point 2 (RP2) and the operating point 1 (OP1) is small. On the other hand, in the case of the comparative example shown in FIG. 13B, the amount of change in the operation load between the release point (RP) and the operating point (OP) is large, and hence it can be recognized that the operating sound of the example is smaller than the operating sound of the comparative example.

The position regulating projecting portion is not limited to being arranged on the turning member and may be arranged on the movable contact piece.

Moreover, one or more embodiments of the present invention are not limited to arranging the position regulating projecting portion of a separate body on the turning member or the movable contact piece, and projection work may be performed on the turning member or the movable contact piece so that the position regulating projecting portion is integrally arranged in a projecting manner.

The switch according to one or more embodiments of the present invention are not limited to one described above, and may, of course, be applied to other push switches.

DESCRIPTION OF SYMBOLS

10: base
11: turn receiving portion
20: common terminal
21: arm
22: engagement receiving portion
23: constantly-closed fixed contact terminal
25: constantly-closed fixed contact
26: constantly-opened fixed contact terminal
28: constantly-opened fixed contact
30: turning member
31: position regulating portion
32: raised piece
33: cutout groove
34: lock hole
35: turning hinge portion
40: movable contact piece
41: leg
42: engagement receiving portion
43: movable contact
44: lock hole
50: coil spring
51: one end
52: other end
53: position regulating projecting portion
60: case
61: operation hole
62: annular rib
63, 64: guide groove
66: engagement hole
70: dustproof cover
80: push button (operation member)
81: operation head
82: lower end face
83: guide protrusion
84: guide projection While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

The invention claimed is:

1. A switch comprising:

a movable contact piece having one end as a supporting point of turn and another end arranged with a movable contact;

a turning member having a supporting point of turn on an end on a same side as the another end of the movable contact piece;

a coil spring having one end locked to one end of the turning member and another end locked to an intermediate portion of the movable contact piece; and a push button supported to be slidable in an up and down direction and for pushing down the one end of the turning member with a lower end face, wherein the movable contact piece is inverted by pushing down the one end of the turning member with the push button so as to make the movable contact approach and separate from a fixed contact, wherein the turning member has a substantially central portion thereof bent to form a position regulating portion that is brought into contact with the coil spring when the movable contact piece is inverted, and wherein the position regulating portion brings the movable contact into contact with the fixed contact while maintaining a contact state with the coil spring.

2. A switch comprising:

a movable contact piece having one end as a supporting point of turn and another the end arranged with a movable contact;

a turning member having a supporting point of turn on an end on a same side as the another end of the movable contact piece;

a coil spring having one end locked to one end of the turning member and another end locked to an intermediate portion of the movable contact piece; and a push button supported to be slidable in an up and down direction and for pushing down the one end of the turning member with a lower end face, wherein the movable contact piece is inverted by pushing down the one end of the turning member with the push button so as to make the movable contact approach and separate to and from a fixed contact, wherein the turning member includes a position regulating projecting portion disposed on a substantially central portion thereof that is brought into contact with the inverted movable contact piece, and wherein the position regulating projecting portion brings the movable contact into contact with the fixed contact while maintaining a contact state with the movable contact piece.

3. A switch comprising:

a movable contact piece having one end as a supporting point of turn and another end arranged with a movable contact;

a turning member having a supporting point of turn on an end on a same side as the another end of the movable contact piece;

a coil spring having one end locked to one end of the turning member and another end locked to an intermediate portion of the movable contact piece; and a push button supported to be slidable in an up and down direction and for pushing down the one end of the turning member with a lower end face, wherein the movable contact piece is inverted by pushing down the one end of the turning member with the push button so as to make the movable contact approach and separate to and from a fixed contact, wherein the movable contact piece includes a position regulating projecting portion that is brought into contact with the turning member when inverted, and wherein the position regulating projecting portion brings the movable contact into contact with the fixed contact while maintaining a contact state with the turning member.

4. The switch according to claim 2, wherein the position regulating projecting portion projects integrally from the turning member.

5. The switch according to claim 3, wherein the position regulating projecting portion projects integrally from the movable contact.

6. The switch according to claim 2, wherein a distal end of the position regulating projecting portion contacts the movable contact piece when inverted.

* * * * *